United States Patent [19]

Jeschke

[11] Patent Number: 5,014,619

[45] Date of Patent: May 14, 1991

[54] DEVICE FOR TENSIONING FLEXIBLE PRINTING PLATES ON A PLATE CYLINDER OF A ROTARY PRINTING MACHINE

[75] Inventor: Willi Jeschke, Bad Herrenalb, Fed. Rep. of Germany

[73] Assignee: Heidelberger Druckmaschinen AG, Heidelberg, Fed. Rep. of Germany

[21] Appl. No.: 316,517

[22] Filed: Feb. 28, 1989

[30] Foreign Application Priority Data

Mar. 1, 1988 [DE] Fed. Rep. of Germany ..... 3806526

[51] Int. Cl.[5] ..... B41F 1/28; B41F 21/00

[52] U.S. Cl. ..... 101/415.1; 101/378; 101/383

[58] Field of Search ..... 101/415.1, 368, 375, 101/378, 383, 386, 409

[56] References Cited

U.S. PATENT DOCUMENTS

| | | | |
|---|---|---|---|
| 3,757,691 | 9/1973 | Etchell et al. | 101/415.1 |
| 3,913,480 | 10/1975 | Dauner et al. | 101/415.1 |
| 4,259,904 | 4/1981 | Metje | 101/415.1 |
| 4,596,188 | 6/1986 | Bonomi | 101/415.1 |
| 4,712,476 | 12/1987 | Jeschke | 101/415.1 |
| 4,719,854 | 1/1988 | Ruger et al. | 101/415.1 X |
| 4,724,762 | 2/1988 | Jeschke et al. | 101/415.1 |

FOREIGN PATENT DOCUMENTS

| | | |
|---|---|---|
| 146161 | 1/1981 | Fed. Rep. of Germany . |
| 3519869 | 12/1986 | Fed. Rep. of Germany . |
| 3535138 | 4/1987 | Fed. Rep. of Germany . |
| 3702032 | 8/1988 | Fed. Rep. of Germany . |

*Primary Examiner*—Edgar S. Burr
*Assistant Examiner*—Moshe I. Cohen
*Attorney, Agent, or Firm*—Nils H. Ljungman & Associates

[57] ABSTRACT

The invention relates to a device for tensioning flexible printing plates on a plate cylinder of a rotary printing machine by means of tensioning rails. The tensioning rails are provided in a cylinder channel for clamping the two plate ends. At least one tensioning rail is mounted on spring elements in a freely resilient manner for the purpose of tensioning the printing plates precisely and exactly.

17 Claims, 1 Drawing Sheet

DEVICE FOR TENSIONING FLEXIBLE PRINTING PLATES ON A PLATE CYLINDER OF A ROTARY PRINTING MACHINE

BACKGROUND OF THE INVENTION

1. Field of the Invention

This invention relates to a device for tensioning flexible printing plates on a plate cylinder of a rotary printing machine by means of tensioning rails which are provided in a cylinder channel for clamping the two plate ends. The device includes means for securing the printing plate in register and under tension in a circumferential direction of the plate cylinder 2. Description of the Prior Art Tensioning rails, which have been used in particular with sheet-fed printing machines, are usually mounted in slide guides provided in the cylinder channel. By adjusting means, such as adjusting screws, these tensioning rails, which clamp the ends of the printing plate, can be moved in a circumferential direction of the cylinder so that the printing plate itself can be secured under tension on the outer cylindrical surface of the plate cylinder. Furthermore, it is possible to stretch the trailing plate end or to move it in the axial direction in order to make up register differences. Such slide guides must feature narrow tolerances in order to be able to guarantee an adjustment of the tensioning rails free of play. Moreover, springs are needed for moving the tensioning rails back into their original position and for ensuring a play-free adjustment of the tensioning rails by the adjusting means. With offset printing presses, these slide guides are soiled very easily by the dampening solution and the solutions used for treating the plates, such as washing solutions. Consequently, the parts involved are subject to corrosion so that very precise mounting and tensioning of the printing plates could not be guaranteed.

OBJECT OF THE INVENTION

It is therefore an object of the present invention to provide a possibility of mounting the tensioning rails in the cylinder channel which is trouble-free and ensures very precise and exact tensioning of the printing plates.

SUMMARY OF THE INVENTION

According to the invention, this and other objects are achieved by mounting in a freely resilient manner at least one tensioning rail on spring elements provided in the cylinder channel. By such a means for securing the printing plate in register and under tension in circumferential direction of the plate cylinder and for axially aligning the printing plate, it is possible to secure one or both ends of the printing plate very exactly and under tension and to adjust them in register, if necessary. This embodiment does not include the risk of soiling as occurs with slide guides, and the tensioning rails are mounted so as to be absolutely free from play. The fact that between the spring elements there is a relatively wide space available which can be used for the accommodation of electrical or hydraulic adjusting means and their supply lines constitutes another advantage of this embodiment.

Mounting each tensioning rail on a plurality of spring elements ensures a parallel movement of the tensioning rails, when tensioning the printing plate. With respect to the leading plate end, it is advantageous to design the spring elements as leaf-type springs which enable a spring action of the tensioning rails only in circumferential direction of the plate cylinder so that it is possible to clamp the plate already in register in an axial direction.

Designing the spring elements as round-rod springs which permit a spring action of the tensioning rails in a circumferential and an axial direction of the plate cylinder allows for a plate correction with respect to all directions. It is advantageous to apply, via the spring elements, a pre-tensioning force onto the means for securing the plate in register and under tension, thus ensuring an absolutely play-free adjusting and securing under tension.

A preferred plate cylinder of the present invention has an axially extending cylinder channel having side walls and a base formed therein. There is included a device for tensioning a flexible printing plate on the plate cylinder for a rotary printing machine by means of tensioning rails. The tensioning rails, being mounted in the cylinder channel, are for respectively clamping two plate ends of the printing plate. At least one of the tensioning rails is mounted in the cylinder channel for being moved independently of the other tensioning rail. The at least one tensioning rail includes at least one tensioning screw for securing the printing plate in register and under tension in a circumferential direction of the plate cylinder. The device basically includes spring members mounted in the cylinder channel. The at least one tensioning rail is mounted on the spring members for movement relative to the cylinder channel. The spring members will maintain the at least one tensioning rail in parallel disposition with respect to at least a portion of the cylinder channel when there is the movement of the at least one tensioning rail relative to the cylinder channel.

In a similar preferred plate cylinder, the device more specifically includes the spring members mounted in the cylinder channel in the form of a plurality of spaced-apart spring elements. The spring elements extend from the base of the cylinder channel for supporting the at least one tensioning rail on extended ends of the spring elements. The plurality of spaced-apart spring elements are mounted to extend between the base of the cylinder channel and the at least one tensioning rail for maintaining the at least one tensioning rail in general parallel disposition with respect to at least a portion of the cylinder channel during relative movement therebetween.

DESCRIPTION OF THE PREFERRED EMBODIMENTS

Figure 1:
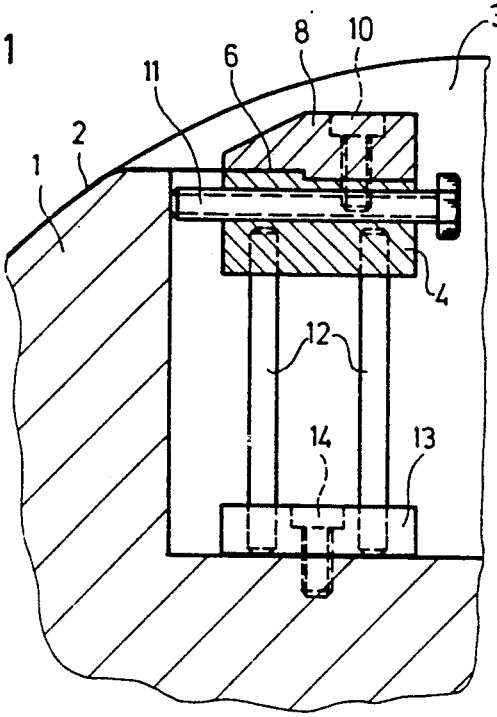
FIG. 1 includes a fragmentary sectional view of a preferred tensioning rail mounted on round-rod springs and including various features of the invention.
Figure 2:
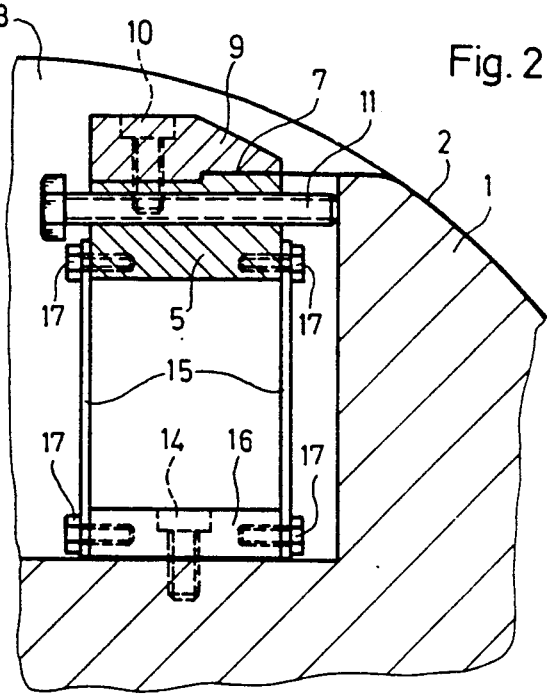
FIG. 2 includes a fragmentary sectional view of another preferred tensioning rail mounted on leaf-type springs and including various features of the invention.

FIGS. 1 and 2 show partial cross sections through a plate cylinder 1 having a respective printing plate 2 mounted and tensioned thereon. In a cylinder channel 3 there are provided tensioning rails 4, 5 respectively for the two plate ends 6, 7. Clamping rails 8, 9 are respectively for clamping the two plate ends 6, 7, and are assigned to the tensioning rails 4, 5. The clamping rails 8, 9 are respectively connected with the tensioning rails 4, 5 by means of screws 10. Means, designed as tensioning screws 11, for securing the printing plate in register and under tension are used to tension the printing plate 2.

Figure 3:
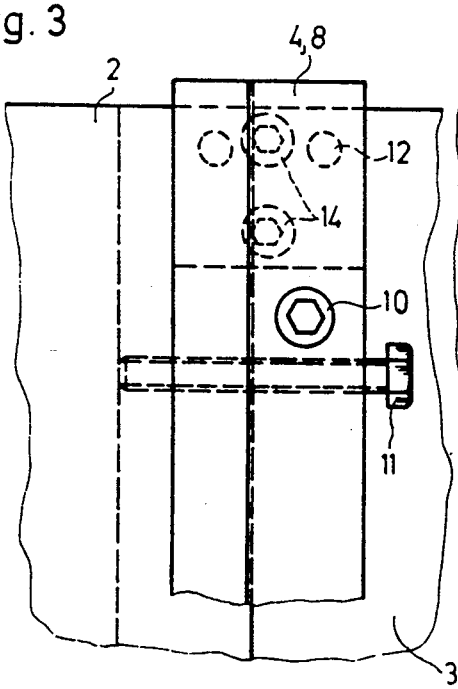
FIG. 3 is a top view of the tensioning rail of FIG. 1.

The round-rod springs 12, illustrated in FIGS. 1 and 3 are fastened in support plates 13 with the upper parts of the round-rod springs supporting the tensioning rail 4. The support plates 13 are secured by means of screws 14 on the base or bottom of the cylinder channel 3. When actuating the tensioning screws 11, the round-rod springs 12 act like an articulated gear or system of levers having articulated connecting joints so that the tensioning rail 4, with the plate end 6 secure therein, moves almost parallel with respect to the plate end 6. Depending on the respective length of the tensioning rail 4 or 5 used, it is possible to provide a plurality of round-rod springs 12. If necessary, it is also conceivable to divide the tensioning rail 4 with respect to its length as long as there is provided a corresponding number of round-rod springs 12.

Figure 4:
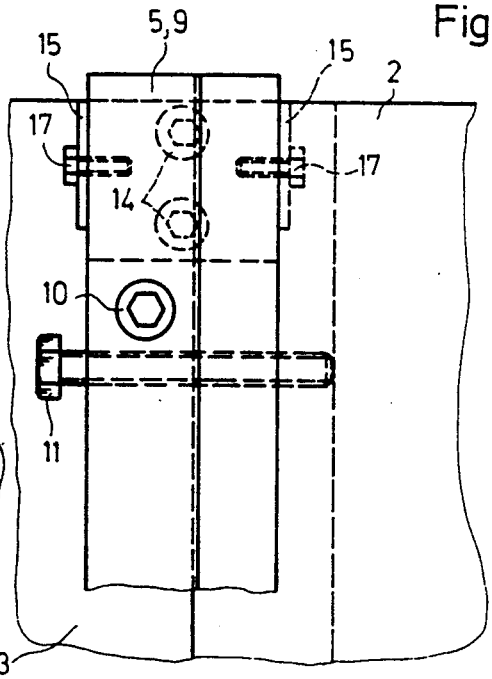
FIG. 4 is a top view of the tensioning rail of FIG. 2.

Instead of round-rod springs 12, it is also conceivable, as seen in FIGS. 2 and 4, to use leaf-type springs 15 as spring elements which, by means of screws 17, are fastened to the support plates 16 on both sides thereof. Moreover, it is possible to screw the upper region of the tensioning rail 5 onto the leaf-type springs 15 respectively on both sides thereof. In this case, too, a tensioning movement parallel to the plate end 7 is achieved when using at least two leaf-type springs for each tensioning rail segment.

In the embodiments shown, the means for securing the printing plate 2 in register and under tension are designed as tensioning screws 11 and are braced against the side walls of the cylinder channel 3. In order to achieve a constant engagement of the tensioning screws 11, it is possible to arrange the support plates 13, 16 somewhat offset towards the side wall of the cylinder channel 3 so that there is applied a pre-tensioning force. Thereafter the printing plate 2 is tensioned against the direction of the pre-tensioning force. In an alternative embodiment, the force required for tensioning the printing plate 2 may be supplied, completely or partially, by the spring elements 12, 15.

Generally, a preferred configuration may include at least a pair of the spring members at each end of a tensioning rail segment although only the pair at one end is specifically shown in FIGS. 3 and 4. With the spring members extending from the support plate 13 or 16, the overall configuration of parallel, spaced-apart spring members will provide general alignment of the tensioning rail above the support plate for initial parallel positioning with respect to the side walls of the channel and to the plate end supported therein. In an unbiased or undeflected condition, it is clear that each of the spring members individually and collectively will tend to maintain this alignment. Additionally, however, the general configuration of a pair of separated or spaced-apart spring members at each end of each tensioning rail segment will tend to allow movement of the tensioning rail segment while maintaining its position in a parallel disposition or manner relative to the side walls of the channel and of the plate end secured therein. Although one or more tensioning screws may be used for tensioning or adjustment at either or both ends of the tensioning rail, the use of the plurality of spring members will tend to cause the entire tensioning rail to remain generally parallel to the channel as it is moved either circumferentially or axially with respect thereto.

As best seen in FIG. 4, because of the significantly greater width than thickness of the leaf-type springs 15, the overall movement of the leaf-type springs 15 is limited to movement in a circumferential direction. The significant width of each of the leaf-type springs 15, as mentioned above, would tend to prevent any axial movement of the leaf-type springs 15 or the tensioning rail 5 mounted thereon with respect to the support plate 16. On the other hand, while the set of parallel spaced-apart, round-rod springs 12 at each end of a segment of the tensioning rail 4 would clearly maintain a general initial parallel disposition of the segment of tensioning rail 4, it would also tend to maintain a general parallel disposition of the segment of the tensioning rail 4 as it moves relative to the side walls of the cylinder channel 3. Although each of the round-rod springs 12 is capable of being deflected or moving in all directions, such deflection or movement would be parallel to other round-rod springs 12 of the overall configuration. Therefore, there could be movement of the segment of tensioning rail 4 in any direction relative the channel 3 while still maintaining the tensioning rail 4 in a disposition parallel with the axis of the cylinder channel 3.

As a result, the initial configuration of the tensioning rail or segments thereof on parallel, spaced-apart spring members at each end thereof will provide proper initial parallel positioning with respect to the side walls of the cylinder channel 3. Further, the general parallel configuration of spaced-apart spring members will provide general biasing to the segment of the tensioning rail 4 or 5 to cause it to have a tendency to remain parallel with the side walls of the cylinder channel 3 as it is being properly tensioned and adjusted by one or more tensioning screws 11.

FIGS. 3 and 4 respectively show a top view of the tensioning means of FIGS. 1 and 2. It is advantageous to arrange respectively the round-rod springs 12 and the leaf-type springs 17 in the end region of the respective tensioning rails 4, 5.

Generally, the device of the present invention is for tensioning flexible printing plates 2 on the plate cylinder 1 of a rotary printing machine by means of tensioning rails 4, 5, which are provided in a cylinder channel 3 and for respectively clamping the two plate ends 6, 7. The tensioning rails include means for securing the printing plate 2 in register and under tension in a circumferential direction of the plate cylinder 1. The device includes at least one of the tensioning rails 4, 5 being mounted in a freely resilient manner on spring elements 12, 15 provided in the cylinder channel 3.

Each of the tensioning rails 4, 5 may be mounted on several spring elements 12, 15. The spring elements can be designed as leaf-type springs 15 enabling a spring action of the tensioning rail 5 only in a circumferential direction of the plate cylinder 1, so that there is no resilience transversely to the direction of motion. On the other hand, the spring elements can be designed as round-rod springs 12 enabling a spring action of the tensioning rail 4 in a circumferential and/or axial direction of the plate cylinder 1.

In either case, because of the spring elements 12, 15, a pre-tensioning force is applied onto a means for securing the printing plate 2 in register and under tension. The means for securing is preferably designed as a tensioning screw 11. In fact, the force required for tensioning the printing plate 2 is supplied, completely or partially, by the spring elements 12, 15.

More specifically, the device of the present invention can be for tensioning a flexible printing plate 2 on a plate cylinder 1 of a rotary printing machine by means of tensioning rails 4, 5, which are resiliently mounted in a cylinder channel 3 and for respectively clamping the two plate ends 6, 7. The tensioning rails include means for securing the printing plate 2 in register and under tension in a circumferential direction of the plate cylinder 1. The device includes the tensioning rail 5 for the leading plate end 7 being mounted on spring elements designed as leaf-type springs 15. The leaf-type springs 15 enable a spring action of the tensioning rail 5 only in the circumferential direction of the plate cylinder 1, whereas transversely with respect to the direction of motion there is no resilience. The tensioning rail 4 for the trailing plate end 6 is mounted on spring elements designed as round-rod springs 12. The round-rod springs 12 enable a spring action of the tensioning rail 4 in the circumferential and axial direction relative to the plate cylinder 1.

Still further, because of the spring elements 12, 15, a pre-tensioning force is applied onto the means for securing the printing plate 2 in register and under tension with the means being designed as tensioning screws 11. The force required for tensioning the printing plate 2 may be supplied, completely or partially, by the spring elements 12, 15.

A number of other devices and means for securing the plate ends to a printing cylinder are disclosed in German Laid Open Patent Applns. Nos. 35 35 138 Al, 35 19 869 Al, and 37 02 032 Al; German Patent No. 146,161; U.S. Pat. No. 4,712,476: and U.S. patent application Ser. No. 233,584. All of the above-mentioned patents and patent applications are incorporated herein by reference as if the entire contents thereof were fully set forth herein.

The invention as described hereinabove in the context of a preferred embodiment is not to be taken as limited to all of the provided details thereof, since modifications and variations thereof may be made without departing from the spirit and scope of the invention.

What is claimed is:

1. In combination with a plate cylinder on a rotary printing machine, said plate cylinder having an axially extending cylinder channel, which channel has side walls and a base formed therein; a device for tensioning a flexible printing plate on said plate cylinder for a rotary printing machine by means of tensioning rails; the flexible printing plate having two plate ends; said tensioning rails being mounted in said cylinder channel; said tensioning rails for respectively clamping the two plate ends of the printing plate; at least one of said tensioning rails being mounted in said cylinder channel for being moved independently of the other of said tensioning rails; said at least one tensioning rail including tensioning means for securing the printing plate in register and under tension in a circumferential direction of said plate cylinder; said device comprising:

spring means mounted in said cylinder channel;

said at least one tensioning rail being mounted on said spring means for movement of said at least one tensioning rail relative to said cylinder channel;

said spring means including means for maintaining said at least one tensioning rail in substantially parallel disposition with respect to at least a portion of said cylinder channel when there is said movement of said at least one tensioning rail relative to said cylinder channel; and said spring means comprising at least one round-rod spring.

2. In combination with a plate cylinder on a rotary printing machine, said plate cylinder having an axially extending cylinder channel which channel has side walls and a base formed therein; a device for tensioning a flexible printing plate on said plate cylinder for a rotary printing machine by means of tensioning rails; the flexible printing plate having two plate ends; said tensioning rails being mounted in said cylinder channel; said tensioning rails for respectively clamping the two plate ends of the printing plate; at least one of said tensioning rails being mounted in said cylinder channel for being moved independently of the other of said tensioning rails; said at least one tensioning rail including tensioning means for securing the printing plate in register and under tension in a circumferential direction of said plate cylinder; said device comprising:

spring means mounted in said cylinder channel;

said spring means comprising a plurality of spaced-apart spring elements;

said spring elements extending from said base of said cylinder channel, said spring elements having an extended end for supporting said at least one tensioning rail;

said plurality of said spaced-apart spring elements being mounted to extend between said base of said cylinder channel and said at least one tensioning rail, thereby maintaining said at least one tensioning rail in general parallel disposition with respect to at least a portion of said cylinder channel during relative movement therebetween; and said spring elements comprising means for being deflectable in at least both of:

said circumferential direction of said plate cylinder and an axial direction of said plate cylinder, said axial direction being substantially transverse to said circumferential direction.

3. The device accirding to claim 2, wherein said extended end of each of said spring elements are deflectable in a multiplicity of directions with respect to said cylinder channel.

4. The device according to claim 3, wherein said spring element is a round-rod spring.

5. The device according to claim 4, wherein said plurality of said spaced-apart spring elements includes at least two round-rod springs at each end of said at least one of said tensioning rails.

6. A device for tensioning a flexible printing plate on a plate cylinder for a rotary printing machine by means of tensioning rails; said tensioning rails each having two ends; said plate cylinder having an axially extending cylinder channel, which channel has side walls and a base formed therein; the flexible printing plate having two plate ends, a leading end and a following end; said tensioning rails being mounted in said cylinder channel; said tensioning rails for respectively clamping the two plate ends of the printing plate; said tensioning rails including tensioning means for securing the printing plate in register and under tension in a circumferential direction of said plate cylinder; said device comprising:

first spring elements, said first spring elements comprising leaf-type springs;

a first of said tensioning rails for the leading one of the two plate ends, said first tensioning rail being mounted on said first spring elements;

said leaf-type springs enabling a spring action of said first tensioning rail only in said circumferential direction of said plate cylinder as said leaf type springs have no substantial resilience in an axial direction which is substantially transverse to said circumferential direction; and a second of said tension rails for the trailing one of the plate ends being mounted on second spring elements designed as round-rod springs, said round-rod springs enabling a spring action of said second of said tensioning rails in said circumferential and said axial directions of said plate cylinder.

7. The device according to claim 6, wherein at least one of said first and said second spring elements produces a pre-tensioning force on said tensioning means;

said tensioning means is designed as tensioning screws; and said tensioning screws have a turned in position and a turned out position.

8. The device according to claim 6, wherein said spring elements at least partially supply a tensioning force required for tensioning the printing plate.

9. The device according to claim 8, wherein said spring elements substantially completely supply said tensioning force required for tensioning the printing plate.

10. The device according to claim 6, wherein said leaf-type springs extend between said base of said cylinder channel and said first of said tensioning rails, said leaf-type springs are parallel and spaced apart.

11. The device according to claim 10, wherein said leaf-type springs include at least two of said leaf-type springs at each said end of said first of said tensioning rails.

12. The device according to claim 6, wherein said round-rod springs extend between said base of said cylinder channel and said second of said tensioning rails, said round-rod springs are parallel and spaced apart.

13. The device according to claim 12, wherein said round-rod springs include at least two of said round-rod springs at each said end of said second of said tensioning rails.

14. The device according to claim 13, wherein said round-rod springs of said second tensioning rail and said leaf-type springs of said first tensioning rail are aligned substantially adjacent to one another at the end regions of respective ones of said tensioning rails.

15. The device according to claim 7, wherein said tensioning screws in said turned-in position being for securing said tensioning rail in a play-free position against said channel side wall during the installation of a printing plate onto said plate cylinder.

16. The device according to claim 15, wherein said tensioning screws in said turned-in position provide said pre-tensioning force.

17. The device according to claim 16, wherein said tensioning screws in said turned-out position provide for free movement of said tensioning rail within said cylinder channel.

* * * * *